US011587538B1

(12) United States Patent
Arya

(10) Patent No.: US 11,587,538 B1
(45) Date of Patent: Feb. 21, 2023

(54) WOODWIND MUSICAL INSTRUMENT FINGER REST AND A SYSTEM INCLUDING THE SAME

(71) Applicant: Saagar Arya, Westerville, OH (US)

(72) Inventor: Saagar Arya, Westerville, OH (US)

( * ) Notice: Subject to any disclaimer, the term of this patent is extended or adjusted under 35 U.S.C. 154(b) by 0 days.

(21) Appl. No.: 17/390,625

(22) Filed: Jul. 30, 2021

Related U.S. Application Data

(60) Provisional application No. 62/704,112, filed on Aug. 1, 2020.

(51) Int. Cl.

| | |
|---|---|
| ***G10D 9/00*** | (2020.01) |
| ***G10D 7/026*** | (2020.01) |
| *G10D 7/03* | (2020.01) |
| *G10D 7/066* | (2020.01) |
| *G10D 7/063* | (2020.01) |

(52) U.S. Cl.
CPC ..... *G10D 9/00* (2013.01); *G10D 7/026* (2013.01); *G10D 7/03* (2020.02); *G10D 7/063* (2013.01); *G10D 7/066* (2013.01)

(58) Field of Classification Search
CPC ..... G10D 9/00; G10D 7/26; G10D 7/03
See application file for complete search history.

(56) References Cited

U.S. PATENT DOCUMENTS 4,348,935 A * 9/1982 Bay ..... G10D 9/00 84/382
4,763,556 A * 8/1988 Peplowski ..... G10D 7/026 84/453
8,269,086 B1 * 9/2012 Tanabe ..... G10D 7/026 84/322

(Continued)

FOREIGN PATENT DOCUMENTS

EP 369431 A * 5/1990 ..... G10D 9/00
JP 2011043660 A * 3/2011
WO WO-2020251483 A1 * 12/2020

OTHER PUBLICATIONS

"FingerPort", FluteWorld Website, Web page <https://www.fluteworld.com/product/fingerport/>, 5 pages, dated at least as early as Jul. 17, 2021, retrieved from www.fluteworld.com website on Jul. 9, 2022.

(Continued)

*Primary Examiner* — Robert W Horn

(74) *Attorney, Agent, or Firm* — The Law Office of Patrick F. O'Reilly III, LLC

(57) ABSTRACT

A woodwind musical instrument finger rest and a system including the same are disclosed herein. The woodwind musical instrument finger rest includes an outer body portion, the outer body portion defining an inner recess, the outer body portion being formed from a first material; and an inner sleeve portion disposed in the inner recess of the outer body portion, the inner sleeve portion being formed from a second material that is different from the first material, the inner sleeve portion being configured to be disposed against an outer surface portion of a tubular wall of a woodwind musical instrument. The woodwind musical instrument finger rest is configured to facilitate a holding of the woodwind musical instrument by a user, and the woodwind musical instrument finger rest is configured to dissipate forces transferred between the woodwind musical instrument and a hand of the user.

20 Claims, 6 Drawing Sheets

(56) References Cited

U.S. PATENT DOCUMENTS

| | | | | |
|---|---|---|---|---|
| 10,410,613 | B2 * | 9/2019 | Harris | G10G 5/005 |
| 2007/0044635 | A1 * | 3/2007 | Lee | G10D 7/026 84/384 |
| 2018/0211642 | A1 * | 7/2018 | Harris | G10G 5/005 |
| 2019/0221198 | A1 * | 7/2019 | Harris | G10D 7/026 |
| 2022/0189441 | A1 * | 6/2022 | Harris | G10D 9/00 |

OTHER PUBLICATIONS

"FluteGels Finger Supports for Flute (Flute Gels)", Amazon Website, Web page <https://www.amazon.com/FluteGels-Finger-Supports-Flute-Gels/dp/B07752DLJC/ref=asc_df_B07752DLJC/?tag=hyprod-20&linkCode=df0&hvadid=312154928868&hvpos=&hvnetw=g&hvrand=6668031308161437614&hvpone=&hvptwo=&hvqmt=&hvdev=c&hvdvcmdl=&hvlocint=&hvlocphy=9014916&hvtargid=pla-567750378413&psc=1>, 8 pages, dated Nov. 3, 2017, retrieved from www.amazon.com website on Jul. 9, 2022.

* cited by examiner

WOODWIND MUSICAL INSTRUMENT FINGER REST AND A SYSTEM INCLUDING THE SAME

CROSS-REFERENCE TO RELATED APPLICATIONS

This patent application claims priority to, and incorporates by reference in its entirety, U.S. Provisional Patent Application No. 62/704,112, entitled "Flute Finger/Thumb Rest", filed on Aug. 1, 2020.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL IN APPENDIX

A set of drawings (FIGS. A-1 through F-4) depicting illustrative embodiments of the woodwind musical instrument finger rest are attached as an appendix to this specification. The contents of these drawings are hereby incorporated by reference in their entirety herein. All dimensions listed in FIGS. A-1 through F-4 are in millimeters.

BACKGROUND OF THE INVENTION

1. Field of the Invention

The invention generally relates to a finger rest for a woodwind musical instrument and a system including the same. More particularly, the invention relates to a finger rest for a woodwind musical instrument that is configured to attach to an outer surface of a tubular wall of the woodwind musical instrument.

2. Background

Woodwind musical instruments are held by the musician while being played. One such common woodwind musical instrument is the flute. The first modern flute was created in Germany in 1830. Since then, the flute has evolved to use gold, silver, aluminum, etc. With the addition of these metals to make flutes, the flute weight dramatically increased, making it harder to hold for longer periods of time. Further, the narrow body of the modern flute makes it harder for those with larger hands to play since they must hold them in awkward positions to compensate. In addition, the metal of the instrument provides no cushioning for the fingers, thereby putting a large amount of stress on the few fingers holding the instrument (i.e., the thumbs and left-hand pointer fingers, which are used to hold the flute). The stress on these fingers makes it harder for those who have developed issues relating to their hands, such as arthritis and tendonitis, to even hold, much less play their flutes. Further, avid flute players, and even novices, often report feelings of pain in their hands after long stretches of holding and playing their flute.

To combat this issue, various attempts at flute finger rests have been made, which include fingerports and the Flute-Gels™. The common issue with many of these is how they address the problems. For instance, many cheaper flute finger rests, are made from hard plastics which damage the flute by leaving scratches. In addition, they do not provide any cushioning to the finger at all and simply serve as helpful reminders as to where a musician's fingers should be placed. Other attempts to solve this problem also have numerous limitations and drawbacks. For instance, many other solutions fail to make the flute more comfortable to hold by not taking stress off the fingers that support the flute. Some products even lack any support to the finger by removing material behind where the finger would be placed, and simply make the flute longer. Further, other solutions use adhesives on the flute which leave a residue on the flute that is hard to get off without damaging the finish of the flute. Because many flutes are quite expensive, leaving residue and scratches on the flute, or not providing finger support, is far from a good option for the musician.

Therefore, what is needed is a woodwind musical instrument finger rest that facilitates a holding of the woodwind musical instrument by a user. Further, a woodwind musical instrument finger rest is needed that is able to dissipate forces transferred between the woodwind musical instrument and a hand of the user.

BRIEF SUMMARY OF EMBODIMENTS OF THE INVENTION

Accordingly, the present invention is directed to a woodwind musical instrument finger rest and a system including the same that substantially obviates one or more problems resulting from the limitations and deficiencies of the related art.

In accordance with one or more embodiments of the present invention, there is provided a woodwind musical instrument finger rest that includes an outer body portion, the outer body portion defining an inner recess, the outer body portion being formed from a first material; and an inner sleeve portion disposed in the inner recess of the outer body portion, the inner sleeve portion being formed from a second material that is different from the first material, the inner sleeve portion being configured to be disposed against an outer surface portion of a tubular wall of a woodwind musical instrument. In these one or more embodiments, the woodwind musical instrument finger rest is configured to facilitate a holding of the woodwind musical instrument by a user, and the woodwind musical instrument finger rest is configured to dissipate forces transferred between the woodwind musical instrument and a hand of the user.

In a further embodiment of the present invention, the outer body portion is in a form of a semi-circular annular member such that the inner recess defined thereby has a semi-circular shape.

In yet a further embodiment, the inner sleeve portion follows a contour of the inner recess of the outer body portion.

In still a further embodiment, the inner sleeve portion extends approximately a full angular range of the outer body portion so as to substantially cover an inner surface of the outer body portion that defines the inner recess.

In yet a further embodiment, the first material forming the outer body portion is a first polymeric material.

In still a further embodiment, the first polymeric material is thermoplastic polyurethane.

In yet a further embodiment, the second material forming the inner sleeve portion is a second polymeric material.

In still a further embodiment, the second polymeric material is silicone.

In yet a further embodiment, the outer body portion is provided with a finger groove formed in an outer surface thereof, the finger groove extending in a circumferential direction about a periphery of the outer body portion.

In accordance with one or more other embodiments of the present invention, there is provided a woodwind musical instrument finger rest system that includes a woodwind musical instrument having a tubular wall, and a woodwind musical instrument finger rest. The woodwind musical instrument finger rest includes an outer body portion, the outer body portion defining an inner recess, the outer body portion being formed from a first material; and an inner sleeve portion disposed in the inner recess of the outer body portion, the inner sleeve portion being formed from a second material that is different from the first material, the inner sleeve portion being configured to be disposed against an outer surface portion of the tubular wall of the woodwind musical instrument. In these one or more embodiments, the woodwind musical instrument finger rest is configured to facilitate a holding of the woodwind musical instrument by a user, and the woodwind musical instrument finger rest is configured to dissipate forces transferred between the woodwind musical instrument and a hand of the user.

In a further embodiment of the present invention, the outer body portion of the woodwind musical instrument finger rest is in a form of a semi-circular annular member such that the inner recess defined thereby has a semi-circular shape.

In yet a further embodiment, the inner sleeve portion of the woodwind musical instrument finger rest follows a contour of the inner recess of the outer body portion.

In still a further embodiment, the inner sleeve portion of the woodwind musical instrument finger rest extends approximately a full angular range of the outer body portion so as to substantially cover an inner surface of the outer body portion that defines the inner recess.

In yet a further embodiment, the first material forming the outer body portion of the woodwind musical instrument finger rest is a first polymeric material.

In still a further embodiment, the first polymeric material is thermoplastic polyurethane.

In yet a further embodiment, the second material forming the inner sleeve portion of the woodwind musical instrument finger rest is a second polymeric material.

In still a further embodiment, the second polymeric material is silicone.

In yet a further embodiment, the outer body portion of the woodwind musical instrument finger rest is provided with a finger groove formed in an outer surface thereof, the finger groove extending in a circumferential direction about a periphery of the outer body portion.

In still a further embodiment, the woodwind musical instrument is provided with a pair of the woodwind musical instrument finger rests disposed at first and second spaced-apart locations along a length of the tubular wall of the woodwind musical instrument, a first one of the woodwind musical instrument finger rests configured to accommodate a first hand of the user, and a second one of the woodwind musical instrument finger rests configured to accommodate a second hand of the user.

In yet a further embodiment, the woodwind musical instrument is selected from a group consisting of: (i) a flute, (ii) a piccolo, (iii) a clarinet, (iv) an oboe, (v) a bassoon, and (vi) a recorder.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

and

Figure 6:
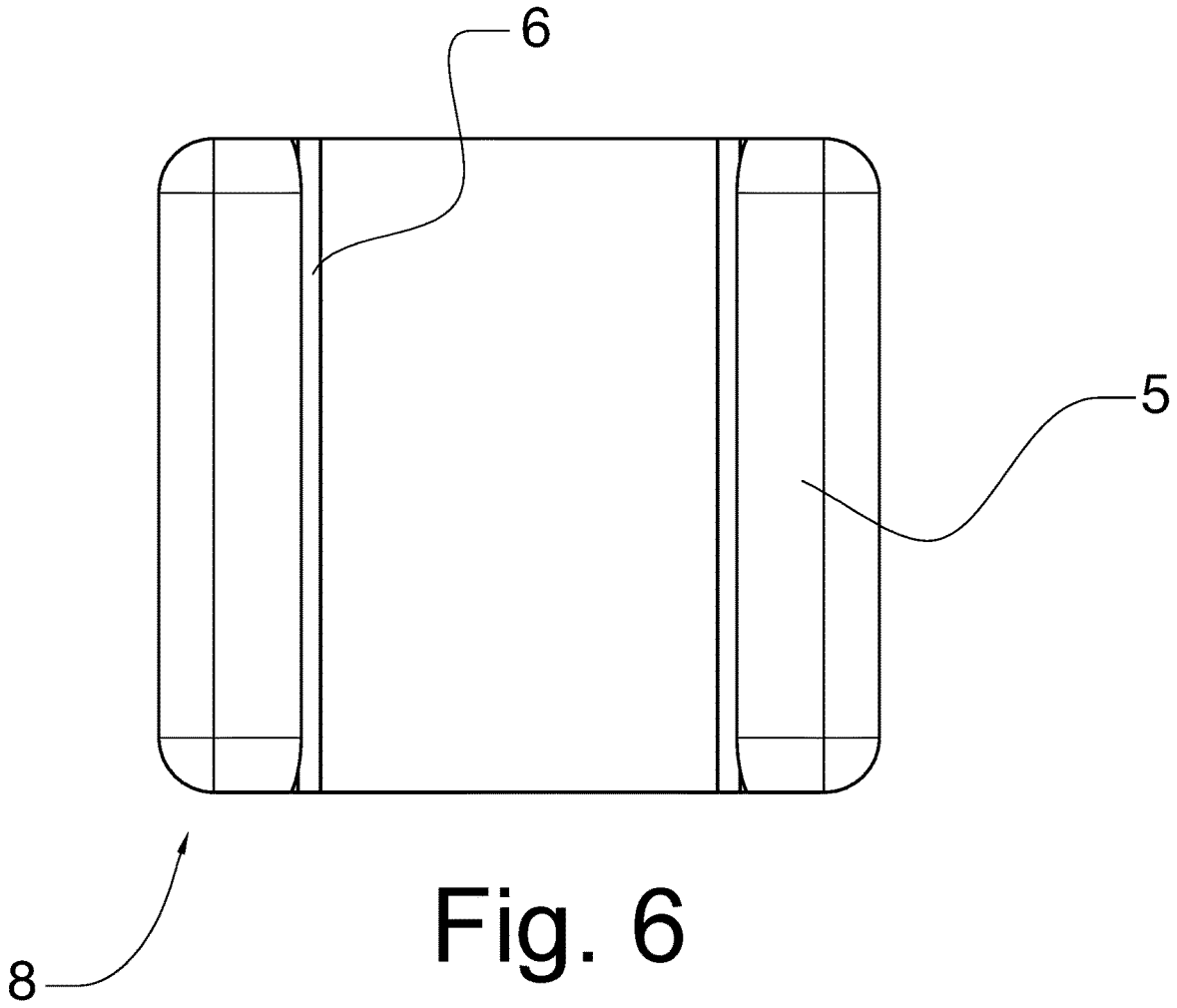
FIG. 6 is a top view of a woodwind musical instrument finger rest, according to a second illustrative embodiment of the invention.
Figure 10:
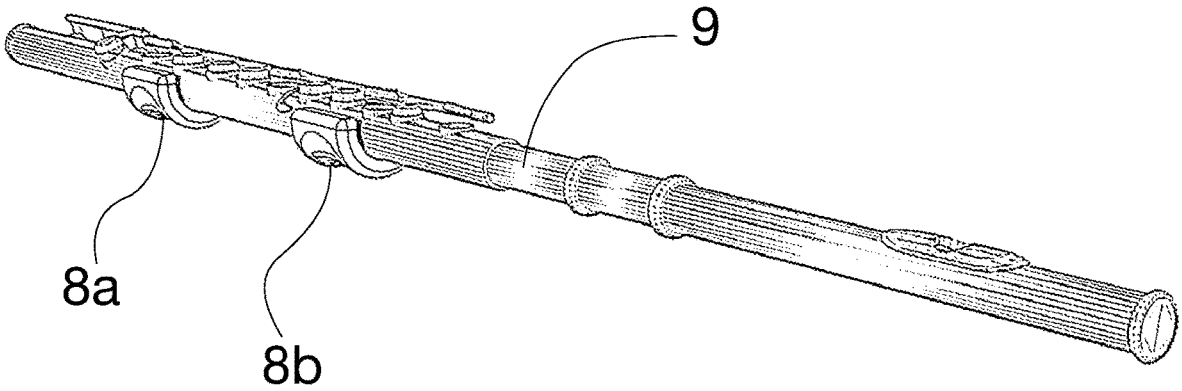

FIG. 10 is a perspective view illustrating a pair of the woodwind musical instrument finger rests of FIG. 6 being disposed on a flute.

Throughout the figures, the same parts are always denoted using the same reference characters so that, as a general rule, they will only be described once.

DETAILED DESCRIPTION OF EMBODIMENTS OF THE INVENTION

A first illustrative embodiment of a woodwind musical instrument finger rest is seen generally at 3 in FIGS. 1-4. With reference to FIGS. 1-4, it can be seen that the woodwind musical instrument finger rest 3 generally comprises an outer body portion 1, the outer body portion 1 defining an inner recess, the outer body portion 1 being formed from a first material; and an inner sleeve portion 2 disposed in the inner recess of the outer body portion 1, the inner sleeve portion 2 being formed from a second material that is different from the first material, the inner sleeve portion 2 being configured to be disposed against an outer surface portion of a tubular wall of a woodwind musical instrument (e.g., a flute 4—see FIG. 5). The woodwind musical instrument finger rest 3 is configured to facilitate a holding of the woodwind musical instrument (e.g., a flute 4) by a user, and the woodwind musical instrument finger rest 3 is configured to dissipate forces transferred between the woodwind musical instrument (e.g., a flute 4) and a hand of the user.

Figure 1:
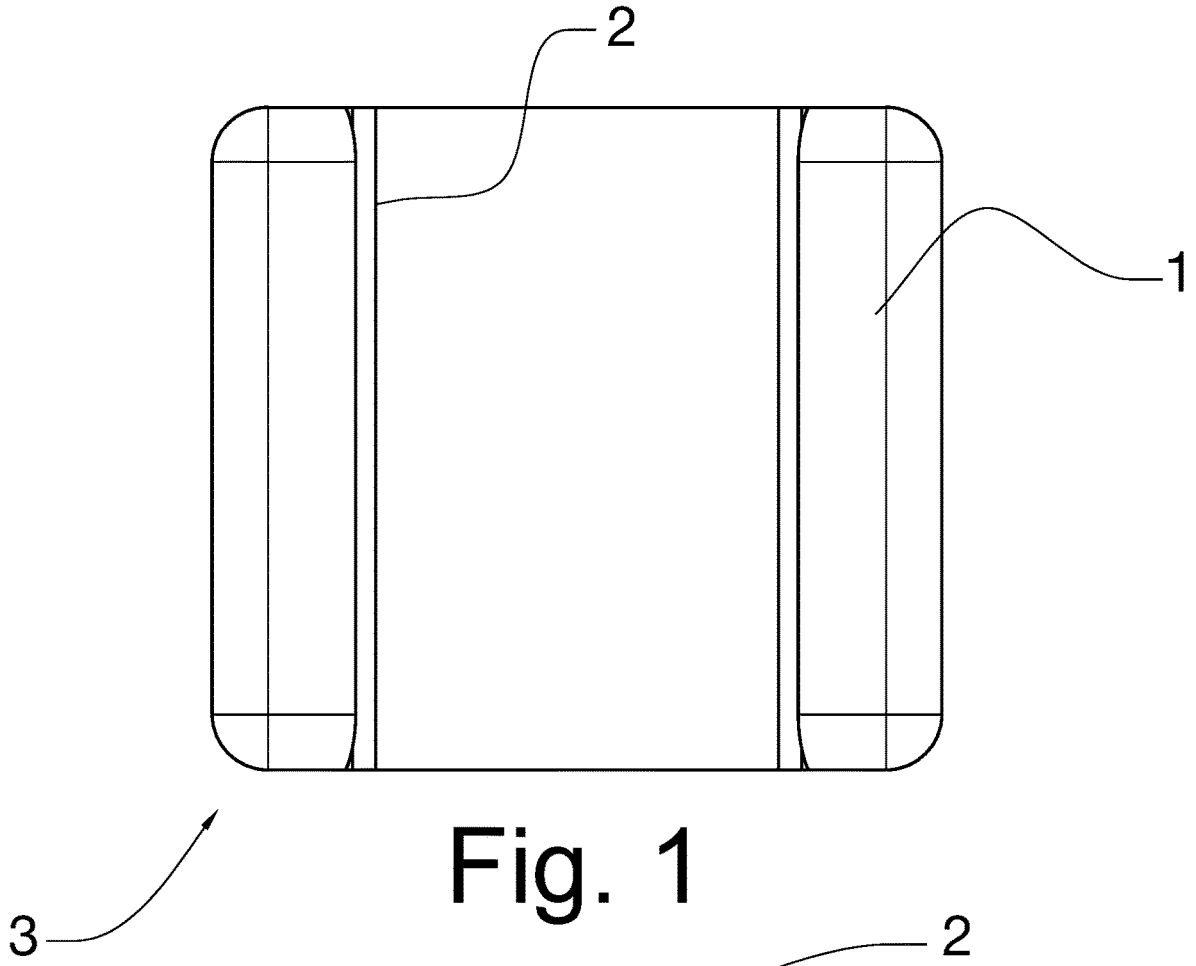
FIG. 1 is a top view of a woodwind musical instrument finger rest, according to a first illustrative embodiment of the invention.
Figure 4:
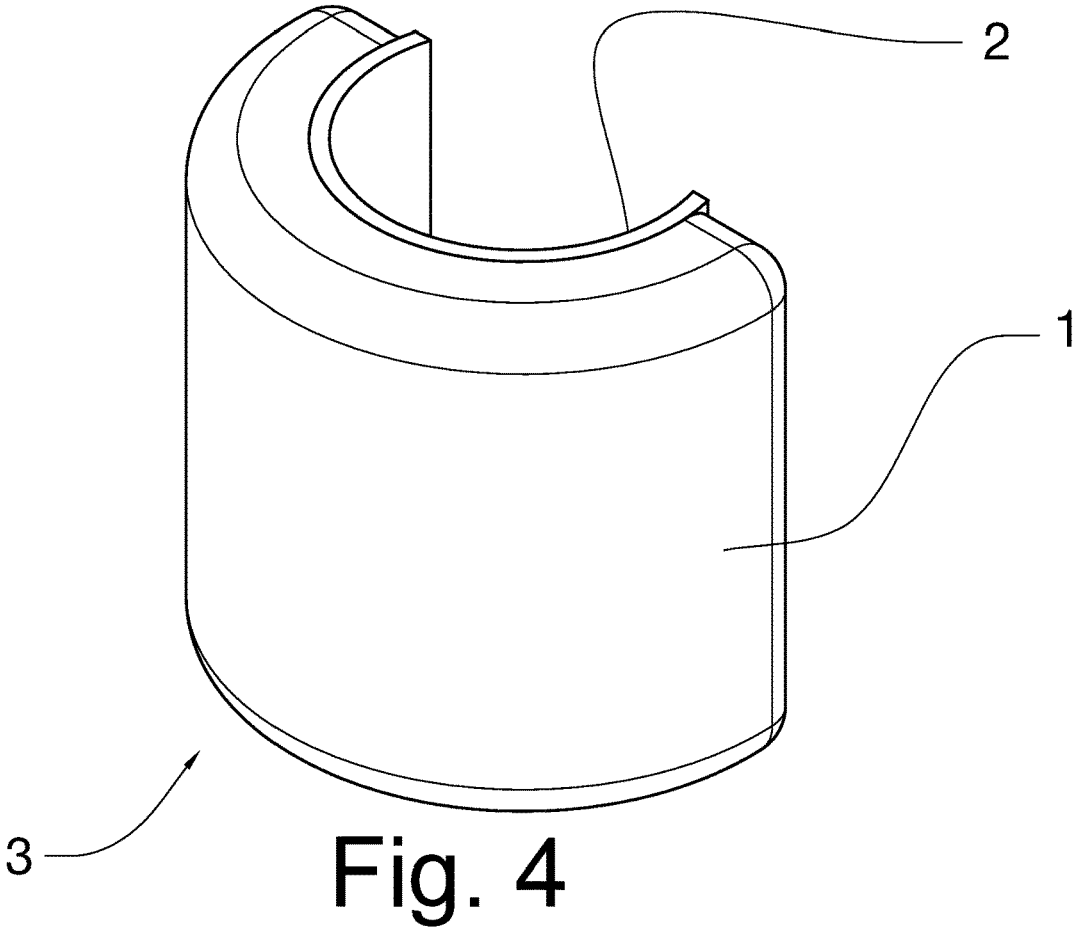
FIG. 4 is a perspective view of the woodwind musical instrument finger rest of FIG. 1.

A perspective view of the first illustrative embodiment of the woodwind musical instrument finger rest 3 is shown in FIG. 4, while a top view of the woodwind musical instrument finger rest 3 is shown in FIG. 1. A first end view of the woodwind musical instrument finger rest 3 is shown in FIG.

Figure 3:
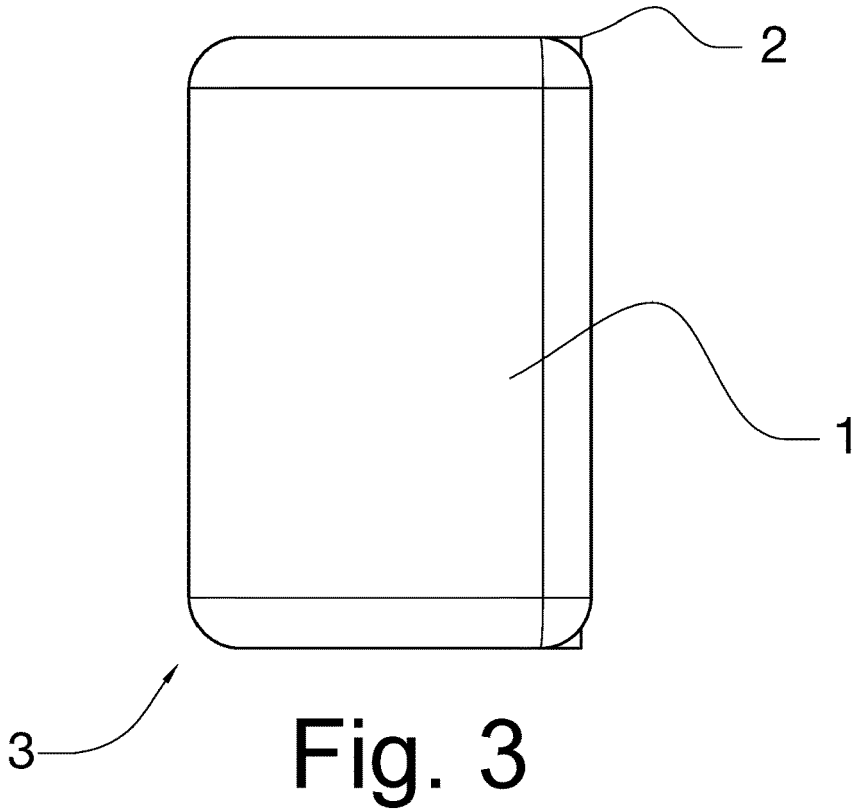
FIG. 3 is an side view of the woodwind musical instrument finger rest of FIG. 1.

2 (the second end view of the woodwind musical instrument finger rest 3 is a mirror image of the first end view). A first side view of the woodwind musical instrument finger rest 3 is shown in FIG. 3 (the second side view of the woodwind musical instrument finger rest 3 is a mirror image of the first side view).

Figure 2:
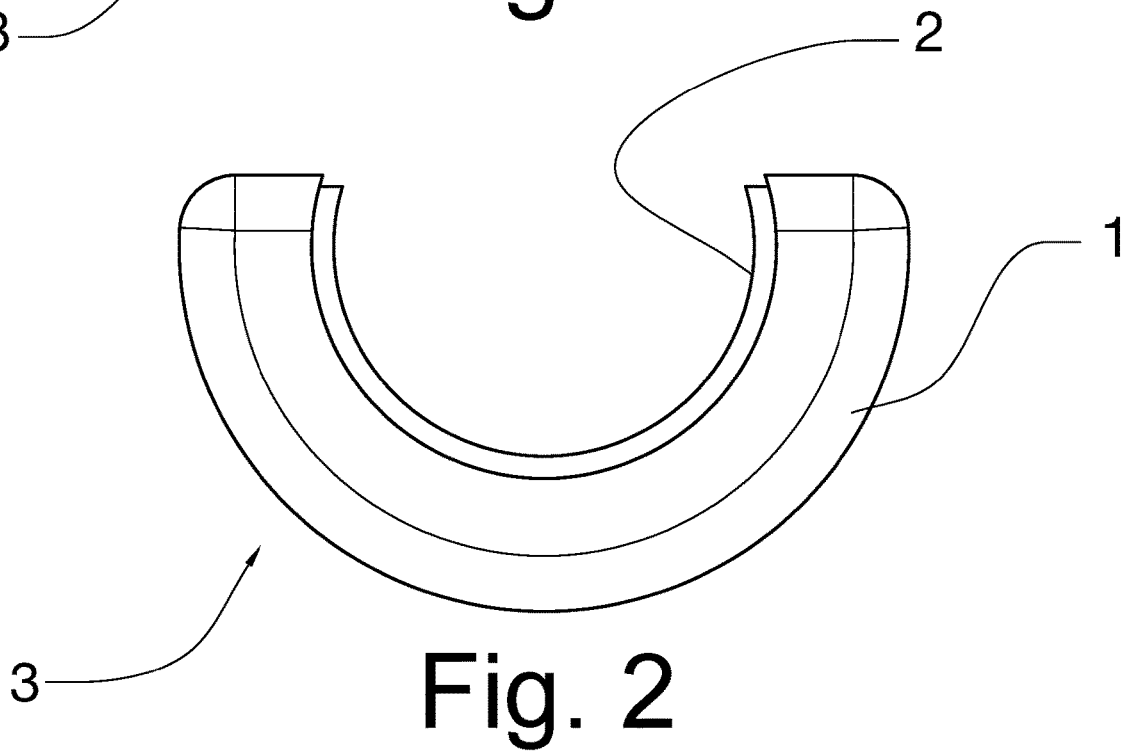
FIG. 2 is an end view of the woodwind musical instrument finger rest of FIG. 1.

As best shown in FIGS. 2 and 4, in the illustrative embodiment, the outer body portion 1 of the woodwind musical instrument finger rest 3 is in a form of a semi-circular annular member such that the inner recess defined thereby has a semi-circular shape. Also, in the illustrative embodiment, the first material forming the outer body portion of the woodwind musical instrument finger rest 3 is a first polymeric material. More specifically, in the illustrative embodiment, the first polymeric material is thermoplastic polyurethane.

Also, as best shown in FIGS. 2 and 4, in the illustrative embodiment, the inner sleeve portion 2 of the woodwind musical instrument finger rest 3 follows a contour of the inner recess of the outer body portion 1. In the illustrative embodiment, the inner sleeve portion 2 of the woodwind musical instrument finger rest 3 extends approximately a full angular range (e.g., between 200 degrees and 205 degrees) of the outer body portion 1 so as to substantially cover an inner surface of the outer body portion 1 that defines the inner recess. Also, in the illustrative embodiment, the second material forming the inner sleeve portion 2 of the woodwind musical instrument finger rest 3 is a second polymeric material. More specifically, in the illustrative embodiment, the second polymeric material is silicone.

Figure 5:
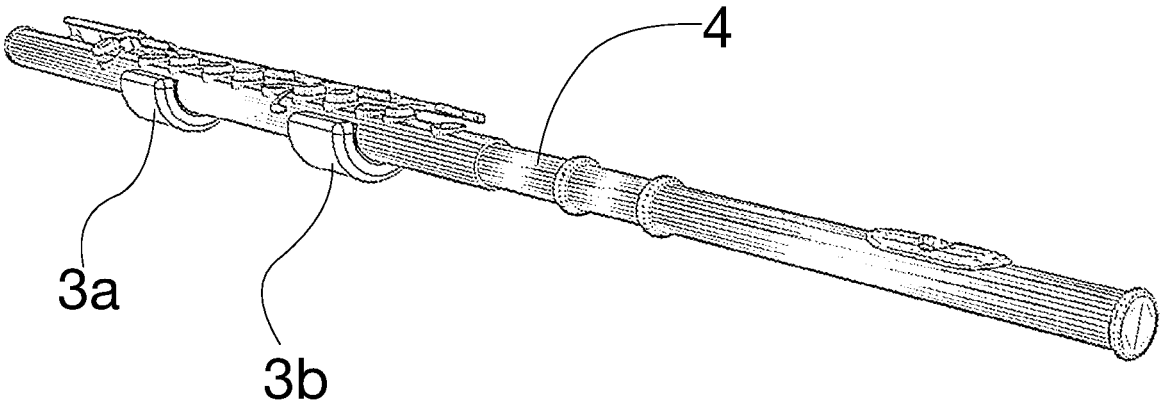
FIG. 5 is a perspective view illustrating a pair of the woodwind musical instrument finger rests of FIG. 1 being disposed on a flute.

An illustrative application of the woodwind musical instrument finger rest 3 is depicted in FIG. 5. As shown in FIG. 5, an exemplary woodwind musical instrument, namely a flute 4, is provided with a pair of the woodwind musical instrument finger rests 3*a*, 3*b* disposed at first and second spaced-apart locations along a length of the tubular wall of the flute 4. A first one 3*a* of the woodwind musical instrument finger rests is configured to accommodate a first hand of the user, and a second one 3*b* of the woodwind musical instrument finger rests is configured to accommodate a second hand of the user while the user is playing the flute 4.

A second illustrative embodiment of the woodwind musical instrument finger rest is seen generally at 8 in FIGS. 6-9. Referring to these figures, it can be seen that, in many respects, the second illustrative embodiment is similar to that of the first illustrative embodiment. Moreover, many elements are common to both such embodiments.

Like the woodwind musical instrument finger rest 3 described above, the woodwind musical instrument finger rest 8 of the second illustrative embodiment generally comprises an outer body portion 5, the outer body portion 5 defining an inner recess, the outer body portion 5 being formed from a first material; and an inner sleeve portion 6 disposed in the inner recess of the outer body portion 5, the inner sleeve portion 6 being formed from a second material that is different from the first material, the inner sleeve portion 6 being configured to be disposed against an outer surface portion of a tubular wall of a woodwind musical instrument (e.g., a flute 9—see FIG. 10). The woodwind musical instrument finger rest 8 is configured to facilitate a holding of the woodwind musical instrument (e.g., a flute 9) by a user, and the woodwind musical instrument finger rest 8 is configured to dissipate forces transferred between the woodwind musical instrument (e.g., a flute 9) and a hand of the user.

Figure 7:
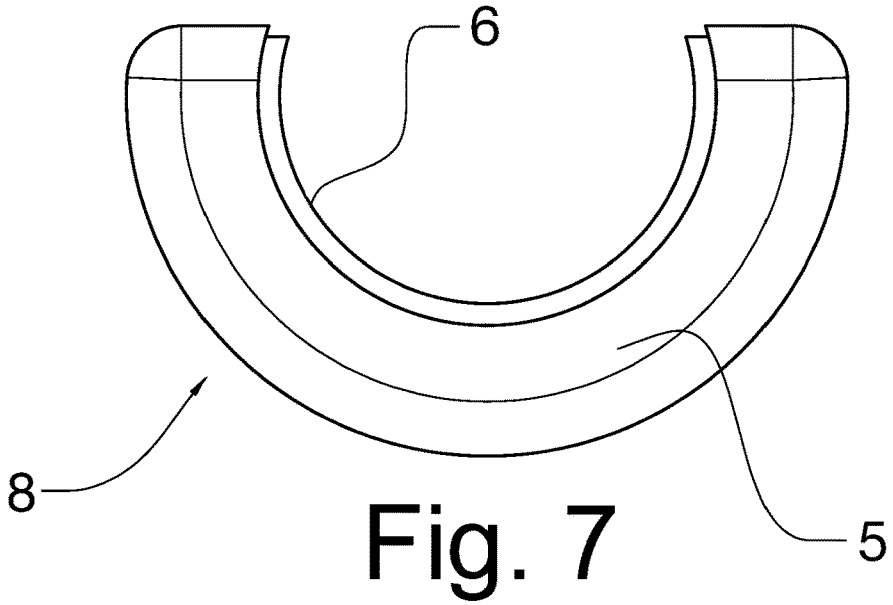
FIG. 7 is an end view of the woodwind musical instrument finger rest of FIG. 6.
Figure 8:
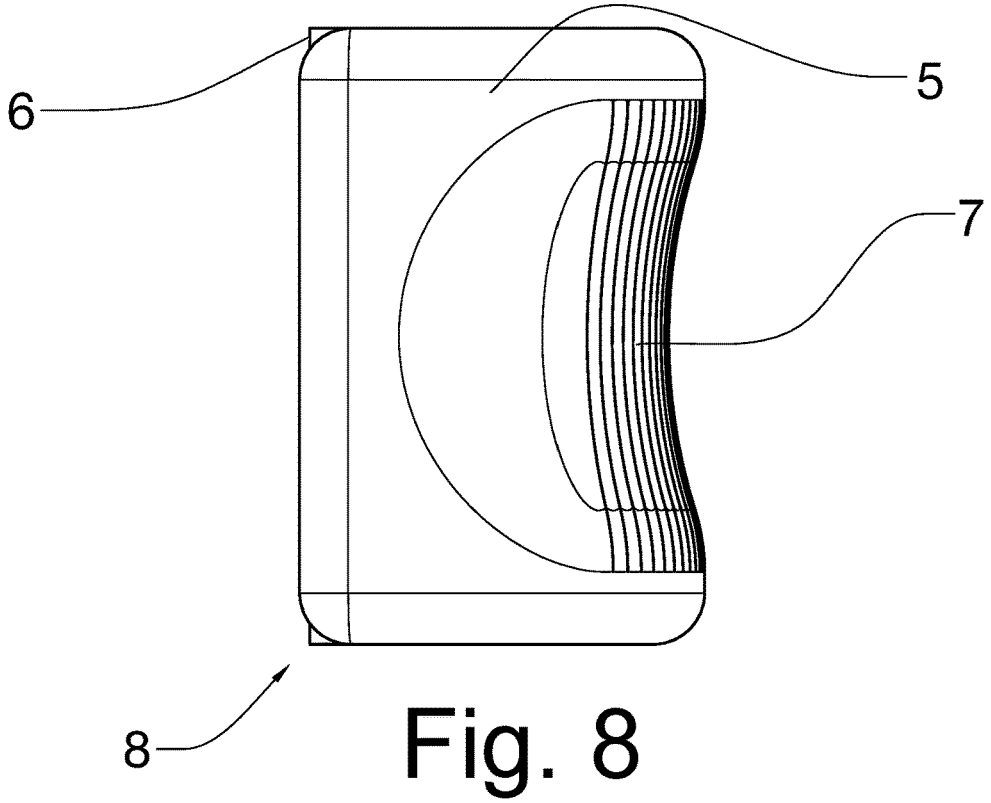
FIG. 8 is an side view of the woodwind musical instrument finger rest of FIG. 6.
Figure 9:
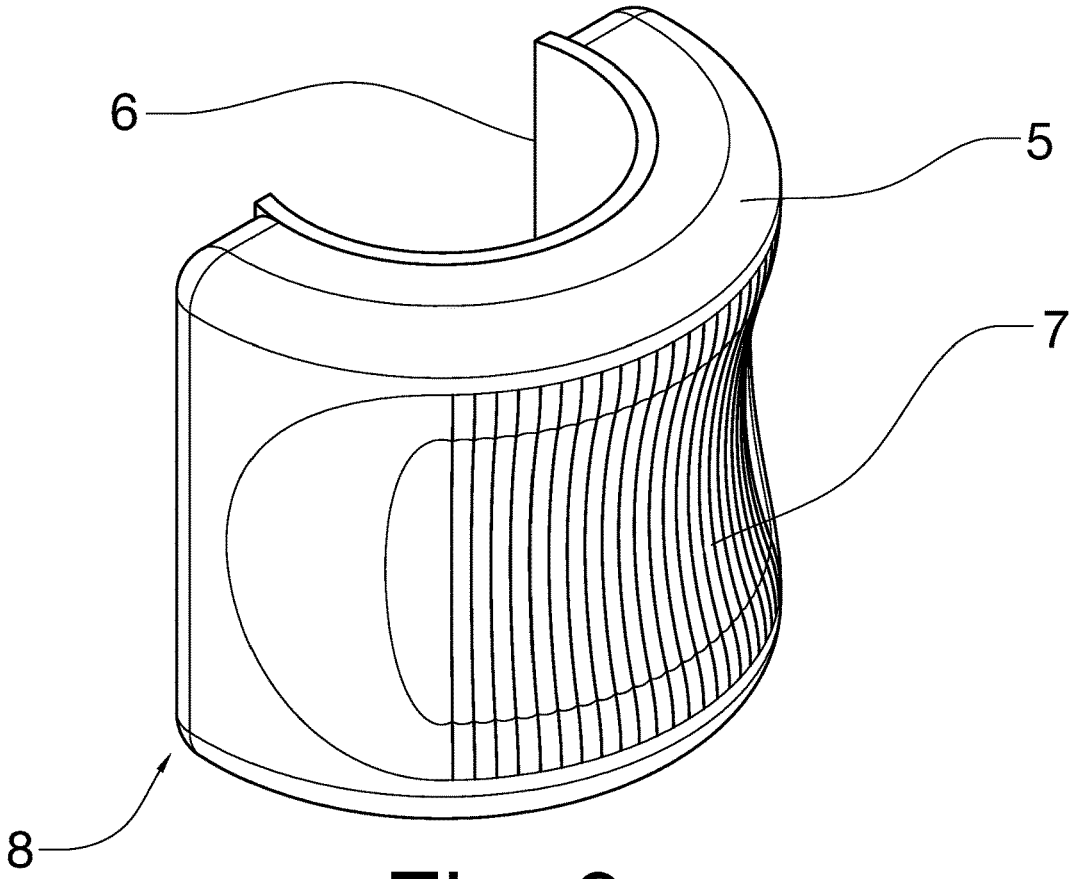
FIG. 9 is a perspective view of the woodwind musical instrument finger rest of FIG. 6.

A perspective view of the second illustrative embodiment of the woodwind musical instrument finger rest 8 is shown in FIG. 9, while a top view of the woodwind musical instrument finger rest 8 is shown in FIG. 6. A first end view of the woodwind musical instrument finger rest 8 is shown in FIG. 7 (the second end view of the woodwind musical instrument finger rest 8 is a mirror image of the first end view). A first side view of the woodwind musical instrument finger rest 8 is shown in FIG. 8 (the second side view of the woodwind musical instrument finger rest 8 is a mirror image of the first side view).

As best shown in FIGS. 7 and 9, in the illustrative embodiment, the outer body portion 5 of the woodwind musical instrument finger rest 8 is in a form of a semi-circular annular member such that the inner recess defined thereby has a semi-circular shape. Also, in the illustrative embodiment, the first material forming the outer body portion of the woodwind musical instrument finger rest 8 is a first polymeric material. More specifically, in the illustrative embodiment, the first polymeric material is thermoplastic polyurethane.

Also, as best shown in FIGS. 7 and 9, in the illustrative embodiment, the inner sleeve portion 6 of the woodwind musical instrument finger rest 8 follows a contour of the inner recess of the outer body portion 5. In the illustrative embodiment, the inner sleeve portion 6 of the woodwind musical instrument finger rest 8 extends approximately a full angular range (e.g., between 200 degrees and 205 degrees) of the outer body portion 5 so as to substantially cover an inner surface of the outer body portion 5 that defines the inner recess. Also, in the illustrative embodiment, the second material forming the inner sleeve portion 6 of the woodwind musical instrument finger rest 8 is a second polymeric material. More specifically, in the illustrative embodiment, the second polymeric material is silicone.

Turning to FIGS. 8 and 9, it can be seen that, unlike the first illustrative embodiment, the outer body portion 5 of the second illustrative embodiment of the woodwind musical instrument finger rest 8 is provided with a finger groove 7 formed in an outer surface of the outer body portion 5 for accommodating a finger of the user. As shown in FIGS. 8 and 9, the finger groove 7 of the illustrative embodiment has a concave cross-sectional shape and extends in a circumferential direction about a periphery of the outer body portion 5 of the woodwind musical instrument finger rest 8.

An illustrative application of the woodwind musical instrument finger rest 8 is depicted in FIG. 10. As shown in FIG. 10, an exemplary woodwind musical instrument, namely a flute 9, is provided with a pair of the woodwind musical instrument finger rests 8*a*, 8*b* disposed at first and second spaced-apart locations along a length of the tubular wall of the flute 9. A first one 8*a* of the woodwind musical instrument finger rests is configured to accommodate a first hand of the user, and a second one 8*b* of the woodwind musical instrument finger rests is configured to accommodate a second hand of the user while the user is playing the flute 9.

While the woodwind musical instrument finger rests 3, 8 are shown being used with a flute 4, 9 in the first and second illustrative embodiments, it is to be understood that the woodwind musical instrument finger rests 3, 8 can be used with a variety of different woodwind musical instruments. For example, in addition to being used with flutes, the woodwind musical instrument finger rests 3, 8 could be modified slightly so as to be used with other woodwind musical instruments, such as piccolos, clarinets, oboes, bassoons, and recorders.

In one or more embodiments, the outer body portion 1, 5 of the woodwind musical instrument finger rest 3, 8 has an inner radius of approximately 10.5 millimeters (mm). In these one or more embodiments, the inner radius of the outer body portion 1, 5 is selected to accommodate the thickness of the inner sleeve portion 2, 6 and the radius of a standard flute 4, 9. In these one or more embodiments, the outer body portion 1, 5 has an outer radius of between approximately 14.5 millimeters (mm) and approximately 18.5 millimeters (mm), inclusive of all values in the range (or between 14.5 mm and 18.5 mm, inclusive of all values in the range). As such, in these one or more embodiments, the outer body portion 1, 5 has a wall thickness between approximately 4.0 millimeters (mm) and approximately 8.0 millimeters (mm), inclusive of all values in the range (or between 4.0 mm and 8.0 mm, inclusive of all values in the range). For example, in these one or more embodiments, the outer body portion 1, 5 may have a wall thickness of approximately 4.0 mm, approximately 6.0 mm, or approximately 8.0 mm. In these one or more embodiments, the wall thickness of the outer body portion 1, 5 is selected to accommodate comfortable finger positions of the user.

In one or more embodiments, the inner sleeve portion 2, 6 of the woodwind musical instrument finger rest 3, 8 has a thickness of approximately 1.0 millimeter (mm). In these one or more embodiments, the thickness of the inner sleeve portion 2, 6 is selected to provide an adequate buffer between the outer wall of the flute 4, 9 and the outer body portion 1, 5. In these one or more embodiments, the inner circumference of the woodwind musical instrument finger rest 3, 8 is made slightly less than the circumference of the outer wall of the woodwind musical instrument (e.g., a flute 4, 9) so that the woodwind musical instrument finger rest 3, 8 attaches to the instrument outer wall by means of a friction fit.

In one or more embodiments, the woodwind musical instrument finger rest 3, 8 has an outer diameter of between approximately 29.0 millimeters (mm) and approximately 37.0 millimeters (mm), inclusive of all values in the range (or between 29.0 mm and 37.0 mm, inclusive of all values in the range). In these one or more embodiments, the woodwind musical instrument finger rest 3, 8 has an overall length of approximately 30.0 millimeters (mm). In these one or more embodiments, the outer diameter and overall length of the woodwind musical instrument finger rest 3, 8 are selected to accommodate comfortable finger positions of the user.

In one or more embodiments, the woodwind musical instrument finger rest 3, 8 extends about the circumference of the flute 4, 9 over an angular range between approximately 200 degrees and approximately 205 degrees, inclusive of all values in the range (or between 200 degrees and 205 degrees, inclusive of all values in the range). For example, in these one or more embodiments, the woodwind musical instrument finger rest 3, 8 may extend about the circumference of the flute 4, 9 over an angular range of approximately 202.5 degrees.

It is readily apparent that the aforedescribed woodwind musical instrument finger rest 3, 8 offers numerous advantages. First, the woodwind musical instrument finger rest 3, 8 facilitates a holding of the woodwind musical instrument by a user. Secondly, the woodwind musical instrument finger rest 3, 8 is able to dissipate forces transferred between the woodwind musical instrument and a hand of the user.

Advantageously, the woodwind musical instrument finger rest 3, 8 variably extends the diameter of the woodwind musical instrument (e.g., the flute 4, 9), thereby making it easier for those musicians with larger hands to hold the instrument since they are not cramped around a small metal tube. In addition, the internal structure of the woodwind musical instrument finger rest 3, 8 allows for an even dissipation of forces between the woodwind musical instrument (e.g., the flute 4, 9) and the hand of the musician. Moreover, because the woodwind musical instrument finger rest 3, 8 fits flush onto the woodwind musical instrument (e.g., the flute 4, 9), it allows for greater dissipation of shocks back into the woodwind musical instrument (e.g., the flute 4, 9), thereby putting even less stress on the supported fingers. As such, the woodwind musical instrument finger rest 3, 8 makes it easier for those musicians with issues, such as tendinitis and even those with arthritis, to play the woodwind musical instrument (e.g., the flute 4, 9). Furthermore, the materials used in the woodwind musical instrument finger rest 3, 8 also provide functional benefits for the musician. In the illustrative embodiment, the silicone inner sleeve portion 2, 6 inside the woodwind musical instrument finger rest 3, 8 creates a flush surface between the body of the woodwind musical instrument (e.g., the flute 4, 9) and the thermoplastic polyurethane outer body portion 1, 5. Further, the silicone material advantageously will not scratch the woodwind musical instrument (e.g., the flute 4, 9) or even leave any residue, thus making it much easier to put on and remove these rests 3, 8. Advantageously, the thermoplastic polyurethane in the illustrative embodiment for the outer body portion 1, 5 is rated to be flexible yet firm, thus allowing for the woodwind musical instrument finger rest 3, 8 to comfortably support the musician's finger without being too soft or hard.

In one or more embodiments, the outer body portion 1, 5 of the woodwind musical instrument finger rest 3, 8 may be formed using a 3D printing process (e.g., from thermoplastic polyurethane filaments having a Shore 95A hardness). Advantageously, the texture given to the outer body portion 1, 5 by the 3D printing process makes the woodwind musical instrument finger rest 3, 8 more appealing to hold and it allows for a grooved texture that is hard to emulate in traditionally manufactured hard plastic parts.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A woodwind musical instrument finger rest, comprising:

an outer body portion, the outer body portion defining an inner recess, the outer body portion being formed from a first material, and the outer body portion being provided with a finger groove formed in an outer surface thereof, the finger groove extending in a circumferential direction about a periphery of the outer body portion; and an inner sleeve portion disposed in the inner recess of the outer body portion, the inner sleeve portion being formed from a second material that is different from the first material, the inner sleeve portion being configured to be disposed against an outer surface portion of a tubular wall of a woodwind musical instrument;

wherein the woodwind musical instrument finger rest is configured to facilitate a holding of the woodwind musical instrument by a user, and the woodwind musical instrument finger rest is configured to dissipate forces transferred between the woodwind musical instrument and a hand of the user.

2. The woodwind musical instrument finger rest according to claim 1, wherein the outer body portion is in a form of a semi-circular annular member such that the inner recess defined thereby has a semi-circular shape.

3. The woodwind musical instrument finger rest according to claim 1, wherein the inner sleeve portion follows a contour of the inner recess of the outer body portion.

4. The woodwind musical instrument finger rest according to claim 3, wherein the inner sleeve portion extends approximately a full angular range of the outer body portion so as to substantially cover an inner surface of the outer body portion that defines the inner recess.

5. The woodwind musical instrument finger rest according to claim 1, wherein the first material forming the outer body portion is a first polymeric material.

6. The woodwind musical instrument finger rest according to claim 5, wherein the first polymeric material is thermoplastic polyurethane.

7. The woodwind musical instrument finger rest according to claim 1, wherein the second material forming the inner sleeve portion is a second polymeric material.

8. The woodwind musical instrument finger rest according to claim 7, wherein the second polymeric material is silicone.

9. A woodwind musical instrument finger rest system, comprising:

a woodwind musical instrument having a tubular wall; and a woodwind musical instrument finger rest that includes:

an outer body portion, the outer body portion defining an inner recess, the outer body portion being formed from a first material; and an inner sleeve portion disposed in the inner recess of the outer body portion, the inner sleeve portion being formed from a second material that is different from the first material, the inner sleeve portion being configured to be disposed against an outer surface portion of the tubular wall of the woodwind musical instrument;

wherein the woodwind musical instrument finger rest is configured to facilitate a holding of the woodwind musical instrument by a user, and the woodwind musical instrument finger rest is configured to dissipate forces transferred between the woodwind musical instrument and a hand of the user; and wherein the woodwind musical instrument is provided with a pair of the woodwind musical instrument finger rests disposed at first and second spaced-apart locations along a length of the tubular wall of the woodwind musical instrument, a first one of the woodwind musical instrument finger rests configured to accommodate a first hand of the user, and a second one of the woodwind musical instrument finger rests configured to accommodate a second hand of the user.

10. The woodwind musical instrument finger rest system according to claim 9, wherein the outer body portion of the woodwind musical instrument finger rest is in a form of a semi-circular annular member such that the inner recess defined thereby has a semi-circular shape.

11. The woodwind musical instrument finger rest system according to claim 9, wherein the inner sleeve portion of the woodwind musical instrument finger rest follows a contour of the inner recess of the outer body portion.

12. The woodwind musical instrument finger rest system according to claim 11, wherein the inner sleeve portion of the woodwind musical instrument finger rest extends approximately a full angular range of the outer body portion so as to substantially cover an inner surface of the outer body portion that defines the inner recess.

13. The woodwind musical instrument finger rest system according to claim 9, wherein the first material forming the outer body portion of the woodwind musical instrument finger rest is a first polymeric material.

14. The woodwind musical instrument finger rest system according to claim 13, wherein the first polymeric material is thermoplastic polyurethane.

15. The woodwind musical instrument finger rest system according to claim 9, wherein the second material forming the inner sleeve portion of the woodwind musical instrument finger rest is a second polymeric material.

16. The woodwind musical instrument finger rest system according to claim 15, wherein the second polymeric material is silicone.

17. The woodwind musical instrument finger rest system according to claim 9, wherein the outer body portion of the woodwind musical instrument finger rest is provided with a finger groove formed in an outer surface thereof, the finger groove extending in a circumferential direction about a periphery of the outer body portion.

18. The woodwind musical instrument finger rest system according to claim 9, wherein the woodwind musical instrument is selected from a group consisting of: (i) a flute, (ii) a piccolo, (iii) a clarinet, (iv) an oboe, (v) a bassoon, and (vi) a recorder.

19. A woodwind musical instrument finger rest, comprising:

an outer body portion, the outer body portion defining an inner recess, the outer body portion being formed from a first material, the outer body portion having a first end portion and an oppositely disposed second end portion, the first and second end portions being symmetrically arranged relative to a central axis of the woodwind musical instrument finger rest, and the first and second end portions having generally the same wall thickness; and an inner sleeve portion disposed in the inner recess of the outer body portion, the inner sleeve portion being formed from a second material that is different from the first material, the inner sleeve portion being configured to be disposed against an outer surface portion of a tubular wall of a woodwind musical instrument;

wherein the woodwind musical instrument finger rest is configured to facilitate a holding of the woodwind musical instrument by a user, and the woodwind musical instrument finger rest is configured to dissipate forces transferred between the woodwind musical instrument and a hand of the user.

20. The woodwind musical instrument finger rest according to claim 19, wherein the first material forming the outer body portion is a first polymeric material, and the second material forming the inner sleeve portion is a second polymeric material.

* * * * *